US010985481B2

(12) United States Patent
Eisfeld

(10) Patent No.: US 10,985,481 B2
(45) Date of Patent: Apr. 20, 2021

(54) ELECTRIC CONTACTING DEVICE

(71) Applicant: HARTING ELECTRIC GMBH & CO. KG, Espelkamp (DE)

(72) Inventor: Kathrin Eisfeld, Lemfoerde (DE)

(73) Assignee: HARTING ELECTRIC GMBH & CO. KG

( * ) Notice: Subject to any disclaimer, the term of this patent is extended or adjusted under 35 U.S.C. 154(b) by 0 days.

(21) Appl. No.: 16/757,624

(22) PCT Filed: Oct. 16, 2018

(86) PCT No.: PCT/DE2018/100853
§ 371 (c)(1),
(2) Date: Apr. 20, 2020

(87) PCT Pub. No.: WO2019/076406
PCT Pub. Date: Apr. 25, 2019

(65) Prior Publication Data

US 2020/0335891 A1 Oct. 22, 2020

(30) Foreign Application Priority Data

Oct. 20, 2017 (DE) ..... 10 2017 124 594.4

(51) Int. Cl.
*H01R 13/40* (2006.01)
*H01R 12/70* (2011.01)
(Continued)

(52) U.S. Cl.
CPC ..... *H01R 12/7076* (2013.01); *H01R 4/2429* (2013.01); *H01R 12/57* (2013.01);
(Continued)

(58) Field of Classification Search
CPC .. H01R 12/7076; H01R 4/2429; H01R 12/57; H01R 12/585; H01R 12/75; H01R 13/41;
(Continued)

(56) References Cited

U.S. PATENT DOCUMENTS 4,262,984 A * 4/1981 Takahashi ..... H01R 4/2445 439/405
5,021,012 A * 6/1991 Shibano ..... H01R 4/2466 439/607.5
(Continued)

FOREIGN PATENT DOCUMENTS

CN 1 930 746 3/2007
CN 102 509 982 6/2012
(Continued)

OTHER PUBLICATIONS

International Search Report and Written Opinion issued in PCT/DE2018/100853, dated Jan. 30, 2019, with English Translation, 27 pgs.
(Continued)

*Primary Examiner* — Abdullah A Riyami
*Assistant Examiner* — Nelson R. Burgos-Guntin
(74) *Attorney, Agent, or Firm* — Hayes Soloway P.C.

(57) ABSTRACT

In the prior art, there is the disadvantage that automatic population methods for printed circuit boards are worthwhile only for large numbers. On the other hand, individual solutions and small series are expensive and complicated and are currently often implemented in manual work. The present disclosure provides a device which facilitates the population of a printed circuit board economically, even for small series. This is achieved by a device which has a contact carrier having contact elements. The device can firstly be installed on printed circuit boards in high numbers in an automated manner and, secondly, permits the connection of electric components and/or electric cables with only little manual effort.

15 Claims, 4 Drawing Sheets

(51) Int. Cl.

| | |
|---|---|
| ***H01R 4/2429*** | (2018.01) |
| ***H01R 12/57*** | (2011.01) |
| ***H01R 12/58*** | (2011.01) |
| ***H01R 12/75*** | (2011.01) |
| ***H01R 13/41*** | (2006.01) |
| ***H01R 43/02*** | (2006.01) |
| ***H01R 43/20*** | (2006.01) |
| ***H01R 43/26*** | (2006.01) |

(52) U.S. Cl.
CPC ..... *H01R 12/585* (2013.01); *H01R 12/75* (2013.01); *H01R 13/41* (2013.01); *H01R 43/0256* (2013.01); *H01R 43/205* (2013.01); *H01R 43/26* (2013.01)

(58) Field of Classification Search
CPC ... H01R 43/0256; H01R 43/205; H01R 43/26
USPC ..... 439/395
See application file for complete search history.

(56) References Cited

U.S. PATENT DOCUMENTS

| | | | | |
|---|---|---|---|---|
| 6,059,600 | A * | 5/2000 | Vanbesien | H01R 13/41 439/378 |
| 6,302,711 | B1 * | 10/2001 | Ito | H01R 4/028 439/83 |
| 6,632,107 | B1 * | 10/2003 | Vanbesien | H01R 13/645 439/65 |
| 7,252,554 | B2 | 8/2007 | Caveney et al. | H01R 24/00 |
| 8,100,699 | B1 | 1/2012 | Costello | 439/65 |
| 8,105,105 | B2 | 1/2012 | Taniguchi et al. | 439/195 |
| 9,520,666 | B2 * | 12/2016 | Hagemeier | H01R 13/42 |
| 9,742,081 | B1 | 8/2017 | Annis et al. | H01R 12/585 |
| 10,312,612 | B2 * | 6/2019 | Ho | H01R 12/718 |
| 2008/0119093 | A1 * | 5/2008 | Bleicher | H01R 13/04 439/877 |
| 2011/0237122 | A1 * | 9/2011 | Schwarz | H01R 13/514 439/578 |
| 2012/0080626 | A1 * | 4/2012 | Fuerst | B60T 8/3675 251/129.15 |
| 2015/0325956 | A1 | 11/2015 | Schreier et al. | H01R 13/6581 |
| 2018/0342824 | A1 * | 11/2018 | Ho | H01R 12/707 |
| 2020/0136303 | A1 * | 4/2020 | Ito | H01R 13/521 |
| 2020/0335891 | A1 * | 10/2020 | Eisfeld | H01R 12/7076 |

FOREIGN PATENT DOCUMENTS

| | | | |
|---|---|---|---|
| DE | 92 03 355.5 | 8/1993 | H01R 4/24 |
| DE | 298 06 869 | 6/1998 | |
| EP | 0 542 164 | 11/1992 | H01R 4/24 |
| EP | 2 862 237 | 4/2013 | H01R 13/03 |

OTHER PUBLICATIONS

International Preliminary Report on Patentability issued in PCT/DE2018/100853, dated Apr. 21, 2020, 13 pgs.
Chinese Office Action issued in application No. 201880067769.1 dated Nov. 4, 2020, with translation, 15 pgs.

* cited by examiner

ELECTRIC CONTACTING DEVICE

BACKGROUND OF THE INVENTION

The invention is based on a device for electrically contacting electrical components with a printed circuit board.

Contacting mechanisms of this type are required in order to be able to fit printed circuit boards with electrical components in a cost-effective manner.

BRIEF DESCRIPTION OF THE PRIOR ART

Methods for soldering electrical components to printed circuit boards in an automated manner are known from the prior art, for example the so-called "SMT" (Surface Mounted Technology) or the so-called THR (Through Hole Reflow).

It is further known that heat-sensitive components, for example microprocessors, should be connected with a base in an electrically conductive manner by way of a plug connection only after the soldering process, which base in turn was previously soldered to the printed circuit board by way of a soldering process of this type.

The connecting contacts of less heat-sensitive components are usually directly connected with contacts of a printed circuit board in an electrically conductive manner and are mechanically fixed to said contacts of a printed circuit board, for example by way of a solder connection. Alternatively, the so-called "press-in" technology is also known for connecting with the printed circuit board, with which technology components are pressed into a printed circuit board through-contact, without being soldered to their connecting contacts, in order to mechanically and electrically connect them with the corresponding through-contact of the printed circuit board. In addition, the connecting contacts generally have an eyelet, in the region of which they possess sufficient deformability for this purpose.

Finally, insulation displacement contacts are known from documents DE 92 03 355 U1 and U.S. Pat. No. 8,105,105 B2, for example. Document EP 2 862 237 B1 describes their application in a printed circuit board plug connector.

A disadvantage of this prior art is that automated fitting methods for printed circuit boards are only worthwhile for high quantities. By contrast, individual solutions and small series are expensive and complex and are currently often realized at great expense in terms of manual labor.

SUMMARY OF THE INVENTION

The object of the invention involves specifying a device which simplifies the process of fitting a printed circuit board, even for small series, in a cost-effective manner.

The device for electrically contacting a printed circuit board with a plurality of electrical connections of an electrical component and/or with a plurality of conductors of an electrical cable possesses a contact carrier and a plurality of electrically conductive contact elements which are held therein or thereon, wherein the contact carrier has a contact side and oppositely a connection side, and wherein the contact elements each exhibit the following:

- at least one free-standing connecting contact for electrically contacting the printed circuit board, which connecting contact protrudes out of the connection side of the contact carrier, and
- oppositely, a clamping region which possesses at least two bars, between which a slot is formed for receiving the respective electrical connection of the electrical component or the respective conductor of the electrical cable.

The invention has the advantage that contacting the device with the printed circuit board can be automated in large quantities, for example by way of a so-called "SMT" (Surface Mounted Technology) method and/or a so-called "press-in" method. The printed circuit boards which are fitted with the device according to the invention in this way can furthermore be applied universally. Finally, they can be fitted with electrical components and connections in a very flexible manner with only little, for example manual, effort. The printed circuit boards can thus initially be produced in large quantities and can only be adapted to their respective object by being fitted, i.e. their respective application is therefore extremely flexible.

In one preferred configuration, the contact elements are arranged in contacting chambers of the contact carrier, wherein the contacting chambers each have a contact opening at the contact side of the contact carrier, and wherein the clamping regions of the contact elements point in the direction of the respective contact opening or protrude out of it. As a result, the respective clamping region of the contact element is advantageously mechanically protected, and the electrical connections of the respective component and/or the conductors of the corresponding cable are connected with the clamping region in a particularly secure manner.

In this case, the contact carrier can have a respective through opening between its connection side and its contacting chambers, in which through opening a section of the connecting contact of the contact element is received and fixed in a form-fitting manner, and out of which through opening the connecting contact protrudes on the connection side for contacting the printed circuit board. This is particularly advantageous, since the contact carrier is held stable in the contact chamber in this manner, and the connecting contact can be connected with electrical contacts of the printed circuit board in an electrically conductive manner.

It is particularly advantageous for contacting the conductors of the cable if the bars of the contact elements each possess a cutting edge in the direction of the slot, in order to thus cut through an insulation of the conductors if necessary, in order to electrically contact the conductors, which are electrical wires. In this case, the contact elements are insulation displacement terminals, which are well known to the person skilled in the art.

The connecting contact can be designed as a solder contact for soldering with contacts of the printed circuit board. This ensures a high degree of mechanical stability and a particularly effective electrically conductive connection.

Alternatively, the connecting contact can be designed as a so-called "press-in" contact. This has the advantage that the corresponding connection technology is less complex.

The contact elements are advantageously made of metal, for example substantially of copper or iron or aluminum, or an alloy which possesses copper or iron or aluminum as an essential component.

In one preferred configuration, the electrical component can be designed as an upper part of a plug connector. Advantageously, it has an insulating body with through openings and plug contacts arranged therein. In particular, each of the plug contacts can possess a plug-in region and oppositely a connection region with an electrical connection for introducing into the respective slot of a contact element.

In another preferred configuration, the electrical component is designed as a separate connecting element in which the conductors of the electrical cable can be arranged for contacting the contact elements of the contact carrier. In order to simultaneously introduce the conductors into the respective slot of the contact element, in particular an insulation displacement terminal, said conductors of the electrical cables introduced therein are held, in particular fixed, at an angle, in particular perpendicularly, to the insulation displacement terminal. In addition, the connecting element can possess a splice element which splits the conductors of an electrical cable, which has been pushed in, and diverts them in the desired directions respectively. In this way, the conductors which are inserted into the splice element can be deflected separately from one another, in order to hold them, during insertion into the respective insulation displacement terminal, on the connecting element at an angle, in particular perpendicularly, to the slot thereof in a suitable position for this purpose. This is particularly advantageous since the conductors of a cable are generally mechanically flexible and, in this manner, not only experience their configuration which is necessary for contacting, but in particular also experience being fixed on the connecting element in a position which is suitable for contacting. Advantageously, all conductors, together with the connecting element, in particular simultaneously, can be inserted into their respective contact elements, in particular insulation displacement terminals. In this case, the connecting element can be understood as an electrical component. In this case, the ends of the conductors form its electrical connections.

A method for fitting the printed circuit board with an electrical component, such as the upper part of the plug connector or the abovementioned connecting element, for example, has the following steps:

a. electrically connecting the connecting contacts of the contact carrier with corresponding connections of the printed circuit board by soldering or press fitting, as well as mechanically attaching the contact carrier to the printed circuit board;
b. inserting the electrical connections of the electrical component into the slot of the respective contact element and thereby
c. electrically contacting the electrical connections of the electrical component with the connections of the printed circuit board, which are provided for this purpose, by way of the contact elements.

In particular, a method for connecting a multi-conductor electrical cable to the printed circuit board possesses the following steps:

a. electrically connecting the connecting contacts of the contact elements of the contact carrier with corresponding connections of the printed circuit board by soldering or press fitting, as well as mechanically attaching the contact carrier to the printed circuit board;
b. inserting the conductors of the electrical cable into a separate connecting element;
c. separating and deflecting the conductors of the cable by way of a splice element of the connecting element;
d. inserting the conductors together into the slot of the respective contact element and thereby
e. electrically contacting the conductors of the electrical cable with the connections of the printed circuit board, which are provided for this purpose, by way of the contact element.

BRIEF DESCRIPTION OF THE DRAWINGS

One exemplary embodiment of the invention is depicted in the drawings and is explained in greater detail below. In the drawings.

The figures include partially simplified, schematic depictions. Identical reference numbers are partially used for the same, but not necessarily identical elements. Different views of the same elements could be scaled differently.

DETAILED DESCRIPTION OF THE INVENTION

Figure 1A:
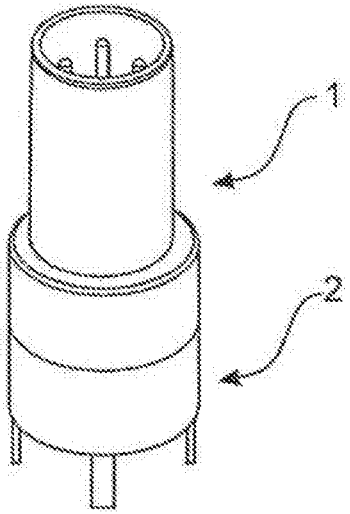
FIGS. 1*a, b* show a printed circuit board plug connector from the outside and in a sectioned depiction.
Figure 1B:
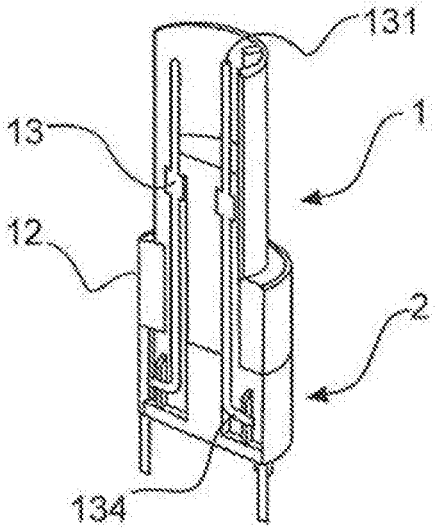
FIG. 1*c* shows an upper part of the printed circuit board plug connector with plug contacts in a sectioned depiction.
FIG. 1*d* shows a fitted contact carrier in a first embodiment as a bottom part of the printed circuit board plug connector.
FIG. 1*e* shows four contact elements in a first embodiment without the contact carrier.

FIGS. 1*a* and 1*b* show a printed circuit board plug connector from the outside and in a sectioned depiction. The printed circuit board plug connector possesses an upper part of a plug connector 1 and a contact carrier 2 with an insulating body 12. On the plug-in side, the insulating body 12 possesses a hollow cylindrical section which is not described in greater detail. Connected thereto, the insulating body 1 is designed to be solid along its course to the contact carrier 2, however it also has through openings in this solid region, in which through openings a plurality of plug contacts 13 are arranged and attached at least in sections. On the plug-in side, the plug contacts 13 protrude into the hollow cylindrical section of the insulating body 1 with their plug-in region 131. They protrude into contact chambers 20 of the contact carrier 2 with their angled connection regions 134 and contact the contact elements 23.

Figure 1C:
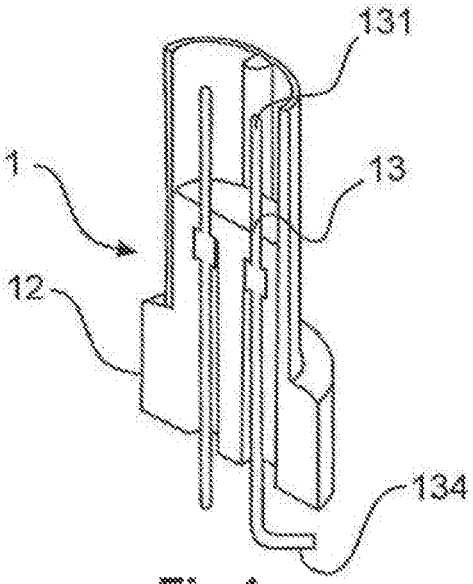

FIG. 1*c* shows the separate upper part of the printed circuit board plug connector 1 with the plug contacts 13 in a sectioned depiction.

Figure 1D:
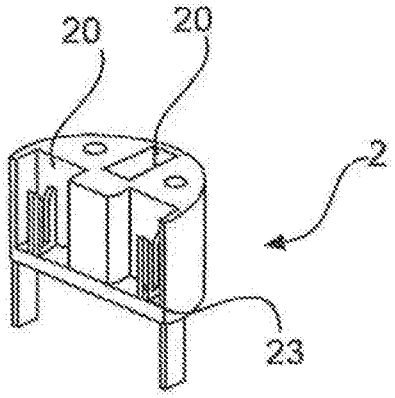

FIG. 1*d* shows a contact carrier 2 which is fitted with contact elements 23 in a first embodiment. In this case, the contact carrier 2 can be regarded as a bottom part of the printed circuit board plug connector. Conversely, the upper part of the plug connector 1 of the preceding depiction can be regarded as an electrical component which is to be connected with solder contacts, for example solder contacts of a printed circuit board 4, via the contact carrier 2. The contact carrier 2 possesses four contact chambers 20, of which only three can be seen in the sectional depiction. The bars 231 of a contact element 23 are arranged in each contact chamber 20 and point in the direction of a contact opening of the contact chamber 20 which is not described in greater detail for reasons of clarity. The contact elements 23 with their connection region 234 are guided through the contact carrier 2 and protrude out of it on the connection side. For this purpose, they engage through a through opening which is not described in greater detail. For this purpose, the contact elements 23 can be encapsulated by the contact carrier 2 which is made of a plastics material, for example.

Figure 1E:
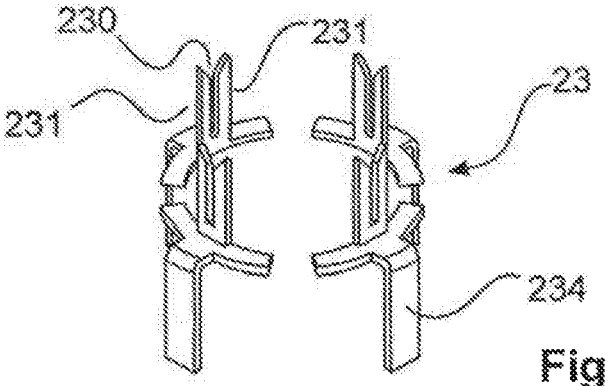

FIG. 1*e* shows a corresponding arrangement made up of four contact elements 23 in a first embodiment. The connection region 234 thereof is clearly visible on the connection side. On the contact side, each of the four contact elements 23 has two bars 231, between each of which a slot 230 is formed for receiving the connection region 134 of the respective plug contact 13.

Figure 2A:
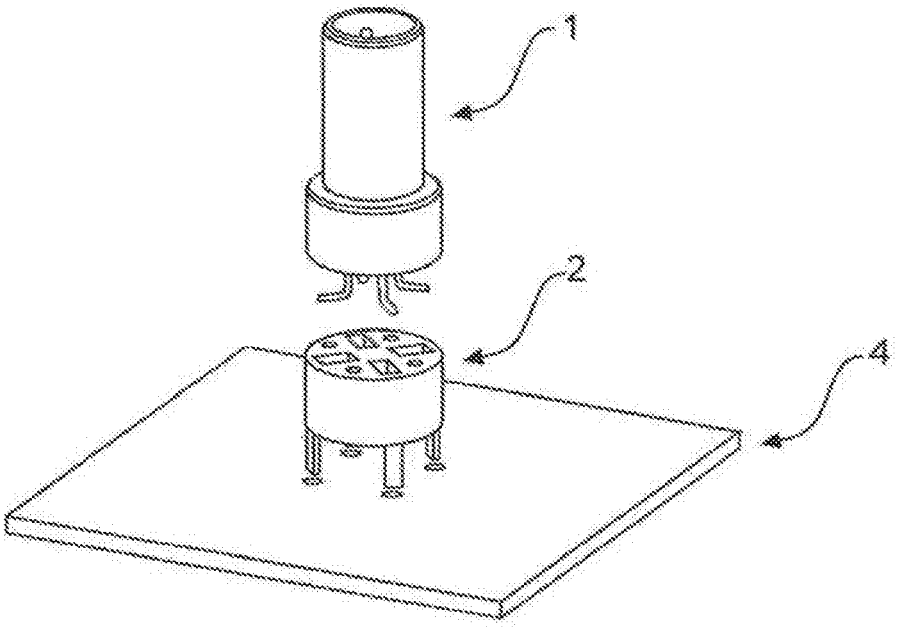
FIGS. 2*a, b* show a different upper part of the plug connector with the contact carrier and a printed circuit board in the separated and in the assembled state.
Figure 2B:
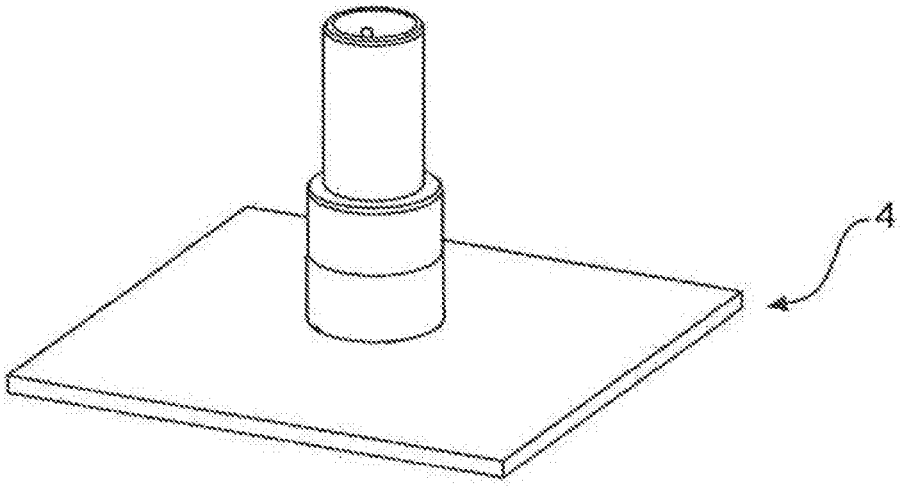

FIGS. 2*a* and 2*b* show the upper part of the plug connector 1 with the contact carrier 2 and a printed circuit board 4 in the separated and in the assembled state. In FIG. 2*b*, the connecting contacts 234 of the contact elements 23 are plugged through contact openings of the printed circuit board 4, which contact openings are not described in greater detail, and are soldered thereto. The connection regions 134 of the plug contacts 13 are, as described previously, guided into the contact chambers 20 and into the slots 230 of the contact elements 23 which are located therein, and are connected thereto in an electrically conductive manner.

Figure 3A:
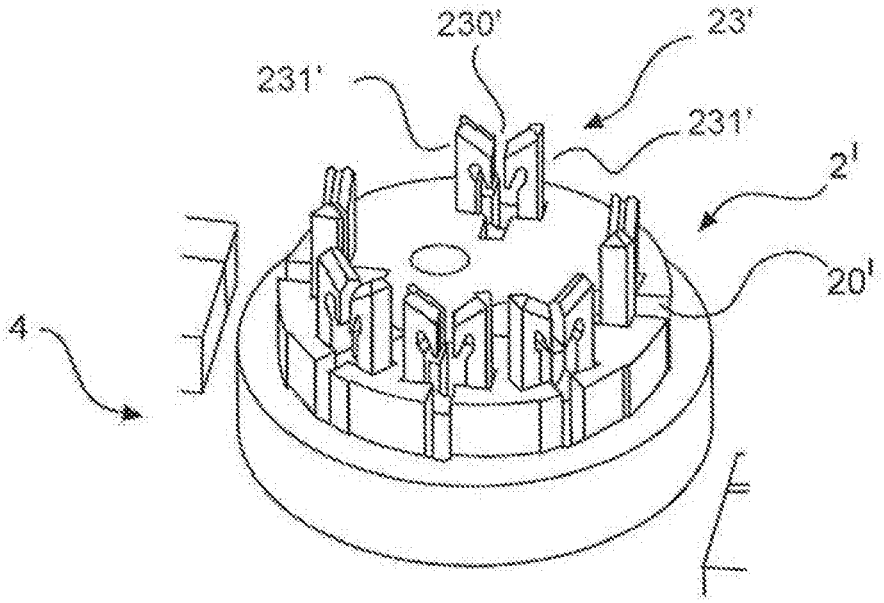
FIG. 3*a* shows a contact carrier which is fitted with contact elements in a second embodiment.

FIG. 3*a* shows a contact carrier 2" which is fitted with contact elements 23" in a second embodiment. In this embodiment, the contact elements 23" protrude with their bars 231" out of the contact openings of the contact chambers 20". In addition to the four contact elements 23" of the preceding depiction, two further contact elements 23 of this type are additionally provided here, for example for connecting further electrical wires, cable conductors, or the like.

Figure 3B:
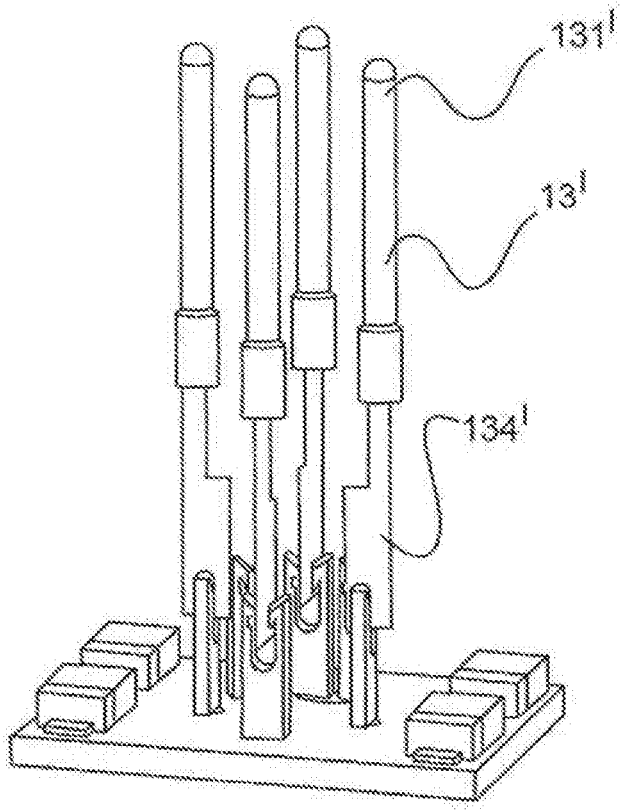
FIG. 3*b* shows the contact elements without the contact carrier with introduced plug contacts in a second embodiment.

FIG. 3*b* depicts the contact elements 23" without the contact carrier 2". Furthermore, plug contacts 13" which are introduced therein are shown in a second embodiment, which plug contacts are different from the plug contacts 13 previously shown in that their connection region 134" is designed to be flat.

Figure 3C:
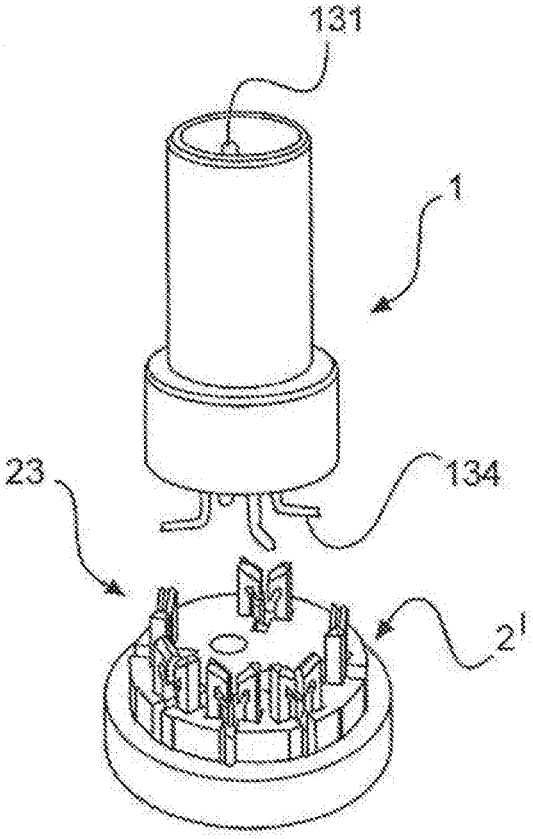
FIG. 3*c* shows the fitted contact carrier with the upper part of the plug connector.

FIG. 3*c* shows the contact carrier 2" which is fitted with contact elements 23" together with the upper part of the plug connector 1 which is to be contacted thereto.

Figure 4A:
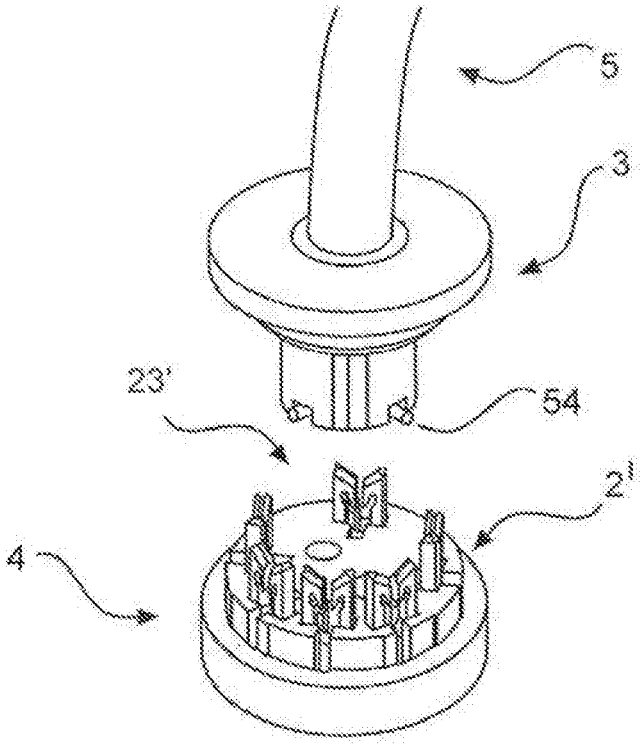
FIG. 4*a* shows the contact carrier which is fitted with contact elements, and a cable with a separate connecting element.

FIG. 4*a* shows the contact carrier 2', which is fitted with contact elements 23', and a cable with a separate connecting element 3. The cable 5 is inserted into the connecting element 3. By way of a splice element which is not shown, four conductors of the cable 5 are deflected in different directions and are held on the connecting end of the connecting element 3 at an angle, namely in this example perpendicularly, to the connection direction. When joining the connecting element 3 and the contact element 2', the ends of the conductors 54 are each located in the position of the corresponding contact elements 23', which, in this case, can preferably be formed as insulation displacement terminals, in order to penetrate the insulation of each conductor if necessary. The ends of the conductors 54 which are to be contacted run at an angle, namely in this case perpendicularly, to the slot 230' of the respective contact elements 23' during contacting.

Figure 4B:
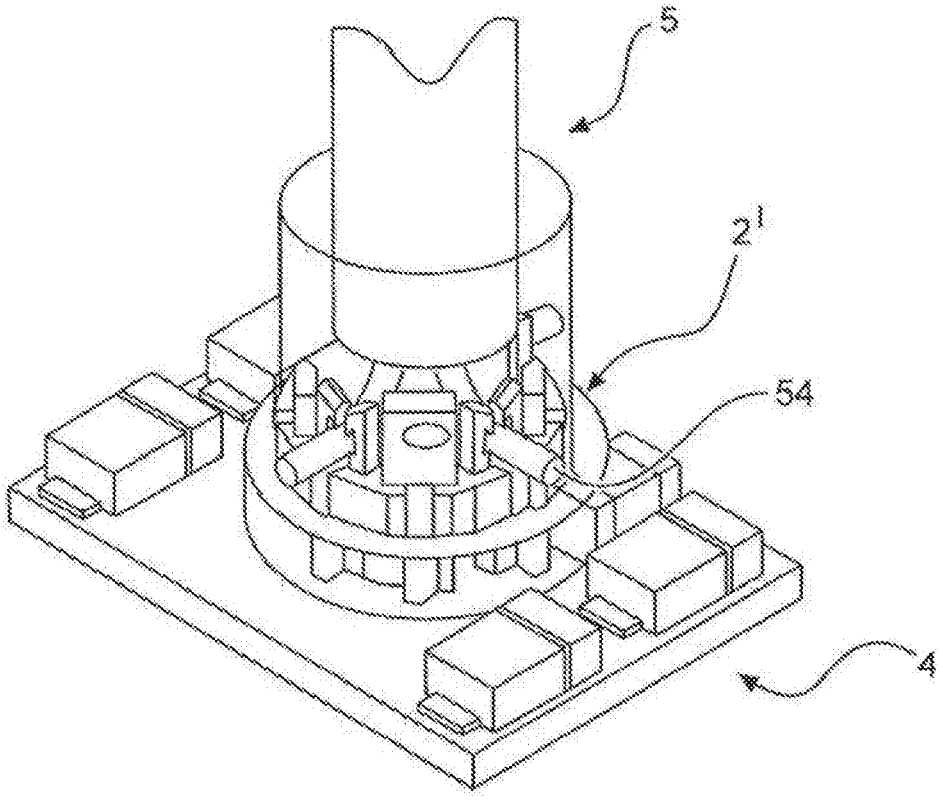
FIG. 4*b* shows the contact carrier with conductors inserted into the contact elements.

FIG. 4*b* shows the contact carrier 2' with the conductors 54 which are inserted into the contact elements 23'. In this case, the connecting element 3 is depicted transparently in order to illustrate contacting.

Even if different aspects or features of the invention are each shown in combination in the figures, it is clear to the person skilled in the art—unless otherwise specified—that the depicted and discussed combinations are not the only possible combinations. In particular, mutually corresponding units or feature complexes from different exemplary embodiments can be exchanged with one another.

LIST OF REFERENCE NUMBERS

1 upper part of the plug connector
12 insulating body
13, 13" plug contacts
131, 131" plug-in region of the plug contacts
134, 134" connection region of the plug contacts
2, 2" contact carrier
20, 20" contact chamber
23, 23" contact elements
230, 230" slot
231, 231" bars
234 connecting contact of the contact element
3 connecting element
4 printed circuit board
5 cable
54 conductors of the cable

The invention claimed is:

1. A device for electrically contacting a printed circuit board with a plurality of electrical connections of an electrical component and/or with a plurality of conductors of an electrical cable, wherein the device possesses a contact carrier and a plurality of electrically conductive contact elements which are held therein or thereon, wherein the contact carrier has a contact side and oppositely a connection side, and wherein the contact elements each exhibit the following:

at least one free-standing connecting contact for electrically contacting the printed circuit board, which connecting contact protrudes out of the connection side of the contact carrier, and oppositely, a clamping region which possesses at least two bars, between which a slot is formed for receiving the respective electrical connection of the electrical component and/or the respective conductor of the electrical cable, wherein the device further has the electrical component which is a separate connecting element, which is configured for holding a plurality of conductors of an inserted electrical cable as electrical connections for simultaneously introducing into the respective slot of a contact element, and wherein the connecting element possesses a splice element into which the conductors of the cable can be inserted together and through which they can be deflected separately, in order to be held on the connecting element as electrical connections in a suitable position for being inserted into the respective contact element, at an angle to the slot thereof.

2. The device as claimed in claim 1, wherein the contact elements are arranged in contacting chambers of the contact carrier, wherein the contacting chambers each have a contact opening at the contact side of the contact carrier, and wherein the clamping regions of the contact elements point in the direction of the respective contact opening or protrude out of it.

3. The device as claimed in claim 2, wherein the contact carrier has a respective through opening as a connection between its connection side and its contacting chambers, in which through opening a section of the connecting contact of the contact element is received and attached in a form-fitting manner, and out of which through opening the connecting contact protrudes on the connection side for contacting the printed circuit board.

4. The device as claimed in claim 1, wherein the bars of the contact elements each possess a cutting edge in the direction of the slot, so that the contact elements are insulation displacement terminals.

5. The device as claimed in claim 1, wherein the connecting contact is a "press-in" contact configured to be pressed into the printed circuit board or as a solder contact to be soldered to contacts of the printed circuit board.

6. The device as claimed in claim 1, wherein the contact elements are made of metal.

7. The device as claimed in claim 1, wherein the connecting element possesses a splice element into which the conductors of the cable can be inserted together and through which they can be deflected separately, in order to be held on the connecting element as electrical connections in a suitable position for being inserted into the respective contact element, at an angle to the slot thereof.

8. The device as claimed in claim 1, wherein the device further has the electrical component which is designed as an upper part of a plug connector and which has an insulating body with through openings as well as plug contacts arranged therein.

9. The device as claimed in claim 8, wherein each of the plug contacts possesses a plug-in region and oppositely a connection region for introducing into the respective slot of a contact element.

10. A method for fitting a printed circuit board with an electrical component using the device as claimed in claim 1, having the following steps:

a. electrically connecting the connecting contacts of the contact elements of the contact carrier with corresponding connections of the printed circuit board by soldering or press fitting, as well as mechanically attaching the contact carrier to the printed circuit board;

b. inserting the electrical connections of the electrical component into the slot of the respective contact element and thereby c. electrically contacting the electrical connections of the electrical component with the connections of the printed circuit board, which are provided for this purpose, by way of the contact element.

11. A method for connecting a multi-conductor electrical cable to a printed circuit board using a device, which possesses a contact carrier and a plurality of electrically conductive contact elements which are held therein or thereon, wherein the contact carrier has a contact side and oppositely a connection side, and wherein the contact elements each exhibit the following:

at least one free-standing connecting contact for electrically contacting the printed circuit board, which connecting contact protrudes out of the connection side of the contact carrier, and oppositely, a clamping region which possesses at least two bars, between which a slot is formed for receiving the respective electrical connection of the electrical component and/or the respective conductor of the electrical cable, having said method comprising the following steps:

a. electrically connecting the connecting contacts of the contact elements of the contact carrier with corresponding connections of the printed circuit board by soldering or press fitting, as well as mechanically attaching the contact carrier to the printed circuit board;

b. inserting the conductors of the electrical cable into a separate connecting element;

c. separating and deflecting the conductors of the cable by way of a splice element of the connecting element;

d. inserting the conductors together into the slot of the respective contact element and thereby e. electrically contacting the conductors of the electrical cable with the connections of the printed circuit board, which are provided for this purpose, by way of the contact elements.

12. The device as claimed in claim 2, wherein the bars of the contact elements each possess a cutting edge in the direction of the slot, so that the contact elements are insulation displacement terminals.

13. The device as claimed in claim 2, wherein the connecting contact is a "press-in" contact configured to be pressed into the printed circuit board or as a solder contact to be soldered to contacts of the printed circuit board.

14. The device as claimed in claim 2, wherein the contact elements are made of metal.

15. The device as claimed in claim 2, wherein the device further has the electrical component which is a separate connecting element, which is configured for holding a plurality of conductors of an inserted electrical cable as electrical connections for simultaneously introducing into the respective slot of a contact element.

* * * * *